US006394290B1

(12) United States Patent
Walsh et al.

(10) Patent No.: US 6,394,290 B1
(45) Date of Patent: May 28, 2002

(54) DISPLAY STAND

(75) Inventors: Thomas F. Walsh, Bedford, NY (US); Jack E. Clemence, Short Hills, NJ (US)

(73) Assignee: Abington Litho and Display Co., Inc., Bedford, NY (US)

( * ) Notice: Subject to any disclaimer, the term of this patent is extended or adjusted under 35 U.S.C. 154(b) by 0 days.

(21) Appl. No.: 09/415,630

(22) Filed: Oct. 12, 1999

(51) Int. Cl.[7] ..... A47F 5/08

(52) U.S. Cl. ..... 211/149; 211/135; 248/174; 108/111; 108/115; 312/259; 206/45

(58) Field of Search ..... 211/149, 135, 211/132.1, 72, 73; 248/174; 312/259, 114, 258; 108/162, 165, 111, 115; 206/477, 45

(56) References Cited

U.S. PATENT DOCUMENTS

| | | | | | |
|---|---|---|---|---|---|
| 1,086,690 | A | * | 2/1914 | Rosenberg | 248/174 |
| 1,497,456 | A | * | 6/1924 | List | 248/174 |
| 1,894,902 | A | * | 1/1933 | Carmichael | 248/174 |
| 1,895,725 | A | * | 1/1933 | Nuckols | 108/100 |
| 1,902,566 | A | * | 3/1933 | Marsh | 248/174 |
| 1,947,195 | A | * | 2/1934 | Flynn | 211/156 |
| 2,571,301 | A | * | 10/1951 | Slanhoff | 211/149 X |
| 2,797,815 | A | * | 7/1957 | Gorman | 211/149 X |
| 2,940,710 | A | * | 6/1960 | Adams | 248/174 |
| 3,438,508 | A | * | 4/1969 | Kuns et al. | 211/133 |
| 3,721,413 | A | * | 3/1973 | Robinson | 248/174 |
| 3,738,604 | A | * | 6/1973 | Howlett et al. | 248/174 X |
| 3,918,576 | A | * | 11/1975 | Taub | 206/44 |
| 3,987,737 | A | * | 10/1976 | Smith | 108/111 |
| 4,151,803 | A | * | 5/1979 | Ferrera et al. | 108/41 |
| 4,311,100 | A | * | 1/1982 | Gardner et al. | 108/111 |
| 4,519,319 | A | * | 5/1985 | Howlett | 108/111 |
| RE32,668 | E | * | 5/1988 | Smith | 211/149 |
| 4,991,804 | A | * | 2/1991 | Iannucci | 248/174 |
| 5,259,578 | A | * | 11/1993 | Jones et al. | 248/174 |
| 5,273,169 | A | * | 12/1993 | Maglione | 211/149 |
| 5,351,882 | A | * | 10/1994 | Krautsack | 229/164 |
| 5,392,902 | A | * | 2/1995 | Vlastakis | 206/45 |
| 5,868,367 | A | * | 2/1999 | Smith | 248/174 |

* cited by examiner

*Primary Examiner*—Curtis A. Cohen
*Assistant Examiner*—Khoa Tran
(74) *Attorney, Agent, or Firm*—Skadden, Arps, Slate, Meagher & Flom LLP

(57) ABSTRACT

A foldable, point-of-purchase display stand is disclosed. The display stand is manufactured from a piece sheet of corrugated board. The display stand has a shelf that is secured by a hook affixed with a pop rivet or eyelet. The disclosed stand is stable for weight-bearing for use in the advertising industry for displaying books and magazines. The display stand of the invention is quickly and easily assembled.

9 Claims, 2 Drawing Sheets

DISPLAY STAND

TECHNICAL FIELD OF THE INVENTION

The invention relates to a display stand for point-of-purchase display in the advertising industry. In particular, the display stand is made from corrugated paper board, is collapsible or foldable, has foldable shelves and is useful for supporting books, magazines and the like.

BACKGROUND OF THE INVENTION

Foldable, corrugated display stands have been used widely in the advertising and retail businesses for displaying announcements and merchandise for sale to consumers. Foldable corrugated display stands provide easy storage. Such display stands are also portable, inexpensive to manufacture, but difficult to assemble. Users of these types of display stands are constantly looking for improved stands that are simple and fast to assemble, without sacrificing the weight-bearing strength of the stand.

One major problem with corrugated cardboard display stands is that the shelves or the whole display stand collapses with time due to the weight of the merchandise being displayed. Specifically, collapsing of the display stand is due primarily to the mechanisms by which the display stands are assembled from a folded state to a weight-bearing position.

U.S. Pat. Nos. 4,493,424; 4,723,664; 5,315,936; 5,366,100; 5,628,523; and reissued U.S. Pat. No. Re. 32,668 disclose various types of constructions for making foldable paper board display stands. However, it is known in the art that the commercially available display stands covered by these patent suffer from the problems mentioned above.

For example, U.S. Pat. No. Re. 32,668 discloses a foldable display stand which is self-erectable and sturdy. The U.S. Pat. No. Re. 32,668 patent discloses that the portions or panels which support the stand as well as the shelves in the erect position, are held together by "an endless elastic element," i.e., a rubber band. However, this type of display stand is known to collapse with time because of the unreliable support mechanism used to erect the stand.

It is known in the art that there are disadvantages with assembled display stands using elastic elements to hold or join cardboard panels together. Specifically, the elastic expands while the stand is weight bearing, thereby losing its strength, causing the shelves to cave in and sag. Moreover, the elastic breaks easily while in use, because elastic is subject to drying out and breaking especially if the stand is warehoused for any length of time prior to use, thereby causing the display stand to collapse.

Since conventional display stand constructions allow for sagging of the shelves and bulging of the display stand with time while in a weight-bearing position, there is a need to improve the mechanisms by which corrugated display stands can be made more durable and stable while displaying the articles. Thus, the present invention provides a foldable display stand made out of corrugated board which is an improved product over the art. The present display stand is more durable and stable, and overcomes the weight-bearing problems of the prior art.

SUMMARY OF THE INVENTION

The present invention relates to a display stand for use in point-of-purchase display in the advertising industry. In particular, the display stand is inexpensive to manufacture by using a simple construction from a single sheet of corrugated paper board. The display stand is useful for displaying books, magazines and the like. The display stand of the invention is an improved product over the prior art display stands in that the shelves for supporting the articles to be displayed, such as books and magazines, have a support and securing means which prevent the, shelves as well as the display stand from bulging or sagging after repeated and extended use. The securing means is preferably a plastic hook affixed to the display stand with pop rivets or eyelets; Affixing the hook by any other means such as hot melt glue is subject to failure. The display stand of the invention is, therefore, more stable and durable, and it is easily assembled from its folded position.

The display stand of the invention is substantially rectangular in shape when assembled, and is manufactured from a single sheet of corrugated paper board. In one embodiment of the invention, the display stand comprises a body and one or more shelves for displaying articles. In this embodiment of the invention, each shelf of the display stand may comprise one or more pockets. In a preferred embodiment, the display stand comprises two shelves and two pockets for displaying books or magazines at the top portion of the display stand. The display stand further comprises a front panel, a back panel and two side panels in its fully assembled or erect position. In this embodiment of the invention, the rear panel is integrally attached to two side panels laterally, forming an edge at the junction at an angle of approximately 90 degrees. The side panels extend to the front of the display and are continuous or connected to a front panel at a perpendicular angle to form a rectangular box-like structure. The two side panels are separated from each other by the width of the back panel when the display stand is fully erected. The top edges of the two side panels are cut in the shape of a step with the lower step starting at the front end of the display stand, and the highest point of the side panels attached to the back panel.

The shelves of the display unit are formed from an extended and foldable portion of the front panel, and a foldable portion of the back panel. The stand is also provided with shelf securing means for connecting the side panels and the shelves, which provide added stability to the display stand while weight-bearing.

DETAILED DESCRIPTION OF THE INVENTION

The present invention relates to a corrugated display stand for use in the advertising industry for displaying articles such as books, magazines or the like. The display stand is foldable and comprises a single paper board structure that when assembled has a substantially rectangular shape forming a box-like structure having an open bottom end. The top portion of the stand is provided with multiple shelves and pockets for displaying the articles.

Figures 1, 2:
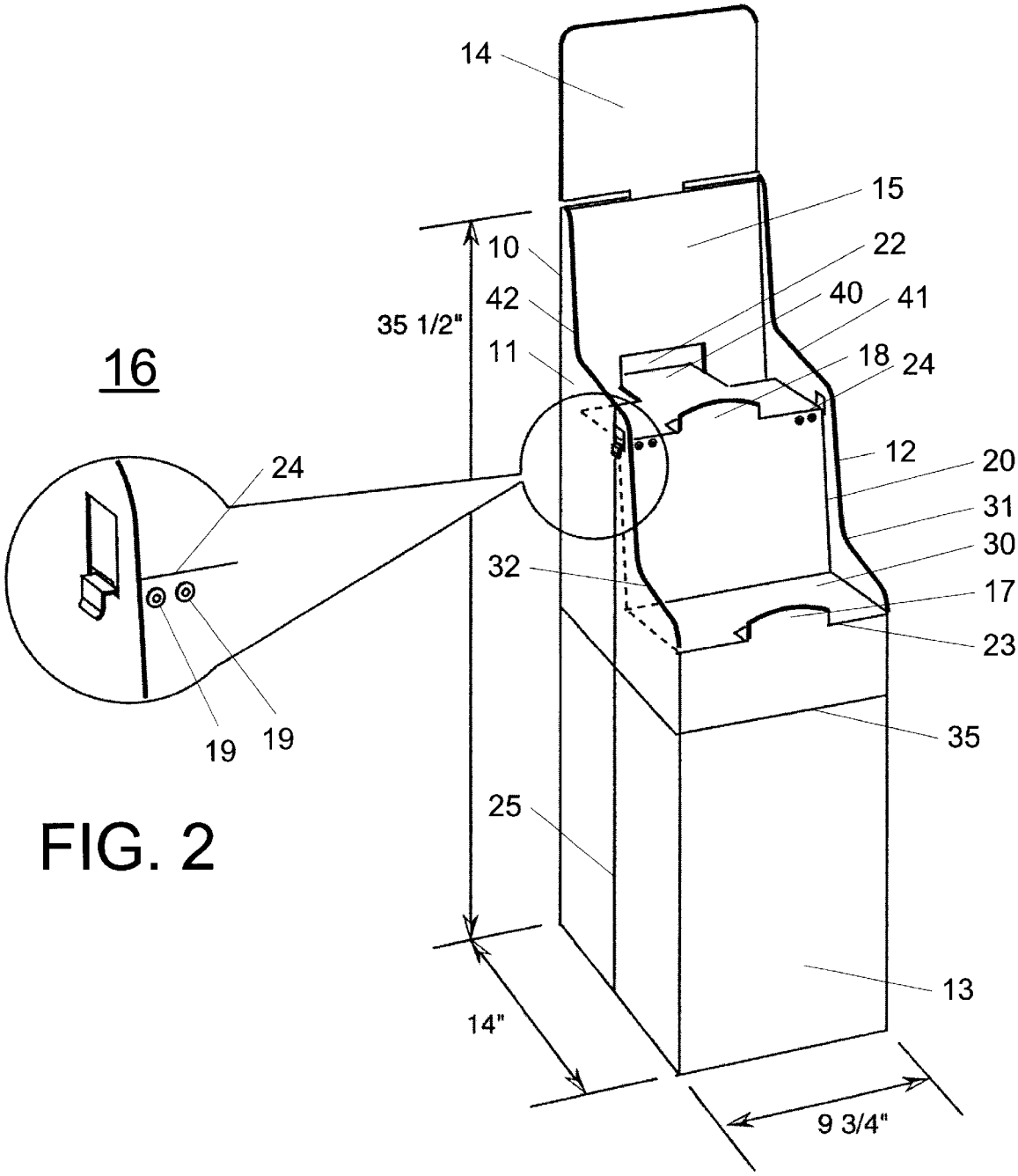
FIG. 1 is a schematic diagram of the display stand of the invention in an assembled position.
FIG. 2 is a schematic diagram of the support and securing means of the display stand of the invention.

In a preferred embodiment of the invention, the foldable display stand as seen in FIG. 1, comprises two shelves 30, 40 with two pockets for displaying books and magazines. The first pocket is formed by shelf 30, lip-like structure 17, side portions 31, 32 and foldable portion 20. The second pocket is formed by shelf 40, lip-like structure 18, side portions 41, 42 and foldable portion 15. The display stand comprises a back panel 10, two side panels 11 and 12, a front panel 13, a top shelf 40, a lower shelf 30, and a shelf support (securing) means 16. In this embodiment of the invention, the back panel 10 comprises a top portion, a bottom edge, and two lateral edges, wherein the top portion extends upwardly as a message board 14 and a foldable section 15 facing towards the front of the display stand and extending downwardly to form a portion of the top shelf of the display stand. The foldable section 15 has a proximal and a distal end with reference to the back panel 10. The back panel 10 further contains a slit at the fold of the proximal end at the junction with the message board 14, and an opening 22 at the distal end. The side panels 11, 12 extend from the lateral edges of the back panel 10 to the front panel 13. Each side panel 11, 12 has a bottom edge, a top edge, a front edge and a back edge; the back edges of the side panel is continuous with the lateral edges of the back panel. The front edges of the side panels 11, 12 are continuous with the front panel 13 and are joined at perpendicular angle. The top edge of the side panels is stepped forming, preferably, a two-step like configuration having the lowest point at the front edge of the panel. Each side panel 11, 12 further has an opening at a midpoint between the front edge and the back edge near the top edge of the panel, for receiving a shelf support (securing) means. The side panels 11 and 12 further have a knock down score or foldable plane 25 along the vertical plane through the midpoint of the panels for folding the display stand when not in use and for preparing it for storage. When folding the stand, each side panel 11, 12 folds outwardly and fold the stand in a vertical plane allowing it to be folded into a flat position.

The front panel 13 comprises a top edge, a bottom edge, two lateral edges which are continuous with the front edges of the side panels. The front panel 13 has the same width as the back panel and is parallel to the back panel 10 in the erect position of the display stand. The front panel 13 further folds in a backward direction, at approximately the same height as the front edge of the side panels, to form the front portion of the shelves of the display stand. The front panel 13 further extends backwards from the fold as a foldable portion 20 containing at least two folds 23, 24, which form the lower shelf 30 and the top shelf 40 of the display stand by engaging with the foldable section 15 of the back panel 10. The foldable portion 20 of the front panel 13 further possesses a slit at its top edge at the beginning of the lower shelf, and a second slit at the beginning of the top shelf which are cut to form a lip-like structure 17 and 18 which serve to hold articles in place and preventing from sliding off from the display stand. The distal or free end of the front panel 13 is configured to engage securely with the opening in the foldable section 15 of the back panel 10.

In a preferred embodiment of the invention, the display stand further, contains a "krack score" 35 along a horizontal plane in the assembled position, which is continuous through all the panels. The krack score 35 serves as one of the planes for folding the display stand to its compact, shipping or storage position.

As seen in FIGS. 1 and 2, the shelf support (securing) means 16 engage the foldable portion 15 of the front panel 13 with the side panels 11, 12 through the openings in the side panel to stabilize the display stand and to prevent the shelves from collapsing. The shelf support means can be of several types, however, it is preferable that they securely hold the shelves to the side panels, and are preferably in the form of hooks. The hooks are then secured to the display stand affixed with pop rivets or eyelets 19.

In a preferred embodiment, the display stand further has the bottom edges of the front, back and side panels all in the same horizontal plane so that a stable base is provided for the display stand. The display stand of the invention can be made of various heights and widths, however, it is preferable that the stand is of approximately 48 inches in height, as measured by the back panel 10. It is also preferred that the width of the display stand, i.e., the width of the front and back panels is approximately 10 inches in width, and most preferably about 9½ inches. Each side panel is preferably 14 inches in width. In this embodiment, the width of the shelves is preferably 9⅛ inches.

Figure 3:
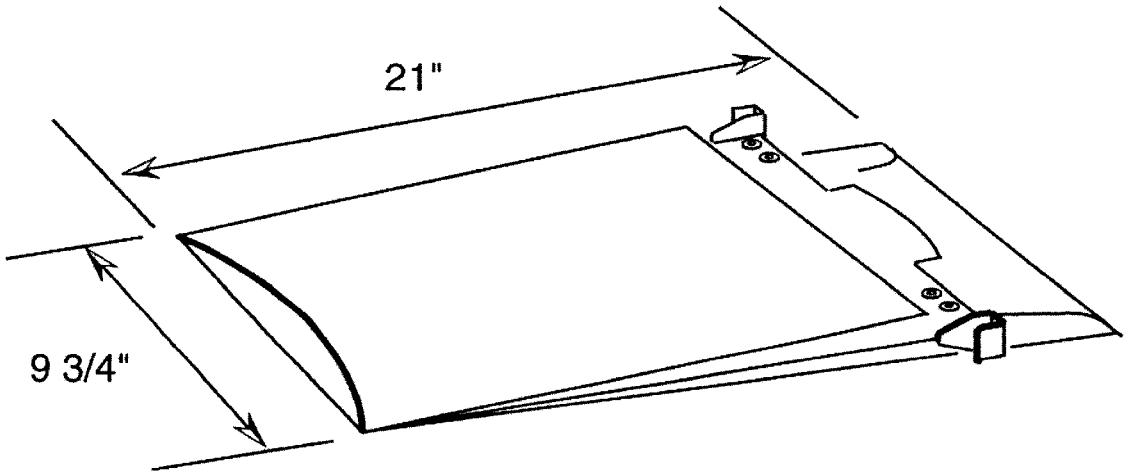
FIG. 3 is a schematic diagram of the display stand of the invention in a folded state.

The construction of the display stand of the invention folds downs for shipment or storage to a compact size (see FIG. 3). In a preferred embodiment, as seen in FIG. 3, the display stand folds down to a structure with dimensions of 9½ by 1½ by 21⅜ inches. This compact size enables the user such as publishers, to better collate displays stands with the articles being displayed, such as books and magazines. To fold the display stand from an erect position, the first fold is made on the vertical plane along the midpoint of the side panels at the knock down score or foldable plane 25, so that the display stand is folded in half and in an outward direction. The second fold is made at the krack score 35 along the horizontal plane of each of the panels.

In another embodiment of the invention, the display stand may contain a plurality of shelves and pockets. In this embodiment, each shelf can contain a single pocket for displaying a single item, or multiple pockets for displaying articles side by side. A shelf comprising multiple pockets further contains a divider between each pocket for separating each pocket of the shelf.

We claim:

1. A foldable display comprising:

a body and at least one shelf, said body and at least one shelf being a single corrugated paperboard structure;

the body comprising a back panel, a first side panel, a second side panel, a front panel, a krack score along a horizontal plane through the body in an assembled position for folding the display stand and means for supporting and securing said shelf against side panels;

the back panel comprising a top edge, a top portion, a bottom edge and two lateral edges, wherein the top portion extends upwardly and has a foldable section extending frontwardly to form a portion of the top shelf and contains a proximal and a distal end, the foldable section of the back panel further contains a slit at the fold of the proximal end at the junction with the top portion, and a relatively square opening at the distal end;

the first and the second side panels extend from the lateral edges of the back panel to the front panel; each side panel comprises a bottom edge, a top edge, a front edge and a back edge; wherein the top edge of the side panels is stepped forming a two-step like configuration having the lowest point at the front edge of the panel; the side panels further having an opening at a midpoint between the front edge and the back edge near the top edge of the panel for receiving said means for supporting and securing said shelf; the first and second side panels having a foldable plane along a vertical plane through the midpoint of the panels for folding the display stand;

the front panel comprises a top edge, a bottom edge, two lateral edges continuous with the front edges of the side panels, and consists of the same width as the back panel; the front panel folds at the height of the front edge of the side panels to form the front portion of the display stand and the top edge of the front panel, the front panel further comprises a foldable portion having a means for engaging with the foldable portion of the back panel to form the top portion of the stand comprising the lower shelf and top shelf; the top portion of the front panel further comprising lips for preventing an article being display from slipping of the stand;

the means for supporting and securing said shelf engages the foldable portion of the front panel with the side panels through the openings in the side panels to stabilize the display stand and to prevent the first and second shelves from collapsing, wherein the means for supporting and securing said shelf comprises a separate hooks of a second material affixed by means for attaching.

2. The display stand according to claim 1, wherein the engaging means of the foldable portion of the front panel comprises an extension of the panel configured to securely fit into the opening of the top portion of the back panel.

3. The display stand according to claim 1, further comprising the bottom edges of the front, back and side panels of all in the same horizontal plane forming a stable base for the display stand.

4. The display stand according to claim 1, wherein the display stand comprises two shelves and two pockets.

5. The display stand according to claim 1, wherein each shelf comprises at least one pockets.

6. The display stand according to claim 1, wherein the means for attaching are chosen from the group consisting of a pop rivet and an eyelet.

7. A foldable display stand comprising a single corrugated paperboard structure; said paperboard structure having a substantially rectangular shape in the form of a box, comprising in the assembled position:

a back panel, a first side panel, a second side panel, a front panel, a top shelf, a lower shelf, and a means for supporting and securing said shelf against side panels;

the back panel comprising a top edge, a top portion, a bottom edge and two lateral edges, wherein the top portion extends upwardly and has a foldable section extending forwardly to form a portion of the top shelf and contains a proximal and a distal end, the foldable section of the back panel further contains a slit at the fold of the proximal end at the junction with the top portion, and a relatively square opening at the distal end;

the first and the second side panels extend from the lateral edges of the back panel to the front panel; each side panel comprises a bottom edge, a top edge, a front edge and a back edge; wherein the top edge of the of the side panel is stepped forming a two-step like configuration having the lowest point at the front edge of the panel; the side panels further having an opening at a midpoint between the front and the back edge near the top edge of the panel for receiving said means for supporting and securing said shelf; the first and second side panels having a foldable plane along a vertical plane through the midpoint of the panels for folding the display stand;

the front panel comprises a top edge, a bottom edge, two lateral edges continuous with the front edges of the side panels, and consists of the same width as the back panel; the front panel folds at the height of the font edge of the side panels to form the front portion of the display stand and the top edge of the front panel the front panel further comprises a foldable portion having a means for engaging with the top portion of the back panel to form the top portion of the stand comprising the lower shelf and top shelf; the foldable portion of the front panel further comprising lips for preventing an article from slipping of the stand;

the means for supporting and securing said shelf engage the foldable portion of the frontal panel with the side panels through the openings in the side panels to stabilize the display stand and to prevent the first and second shelves from collapsing, wherein the means for supporting and securing said shelf comprises a separate hooks of a second material affixed by means for attaching.

8. The display stand according to claim 7, wherein the engaging means of the foldable portion of the front panel comprises an extension of the panel configured to securely fit into the opening of the foldable portion of the back panel.

9. The display stand according to claim 7, wherein the means for attaching are chosen from the group consisting of a pop rivet and an eyelet.

* * * * *